US007232120B2

(12) United States Patent
Campbell et al.

(10) Patent No.: US 7,232,120 B2
(45) Date of Patent: Jun. 19, 2007

(54) QUICK CLAMPING SYSTEM FOR A WORKBENCH

(75) Inventors: David C. Campbell, Bel Air, MD (US); Robert H. Gifford, New Freedom, PA (US); Louis A. Gibbons, Stevensville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/184,726

(22) Filed: Jul. 19, 2005

(65) Prior Publication Data

US 2007/0018371 A1 Jan. 25, 2007

(51) Int. Cl.
*B25B 1/02* (2006.01)

(52) U.S. Cl. ..... 269/139; 269/184

(58) Field of Classification Search ..... 269/137, 269/184, 185–186, 901; 254/98
See application file for complete search history.

(56) References Cited

U.S. PATENT DOCUMENTS

| | | | | |
|---|---|---|---|---|
| 227,582 | A | 5/1880 | Riley | |
| 406,957 | A | 7/1889 | Robinson | |
| 488,368 | A | 12/1892 | Sabourn | |
| 631,991 | A | 8/1899 | James et al. | |
| 1,283,192 | A | 10/1918 | Hughes | |
| 2,262,196 | A | 11/1941 | Olsen | |
| 2,362,067 | A | 11/1944 | Heinrich | |
| 2,392,820 | A | 1/1946 | Heinrich | |
| 2,415,303 | A | 2/1947 | Moore | |
| 2,565,965 | A | 8/1951 | Hartmann | |
| 2,620,695 | A | 12/1952 | Eierman | |
| 2,638,804 | A | 5/1953 | Heinrich | |
| 2,846,907 | A | 8/1958 | Sprink | |
| 3,300,204 | A | 1/1967 | Ahmer | |
| 3,425,681 | A | 2/1969 | Wing | |
| 3,578,308 | A | 5/1971 | Jesionowski | |
| 3,738,613 | A * | 6/1973 | Hollis, Jr. | 254/420 |
| 3,756,092 | A | 9/1973 | Gartner | |
| 3,981,607 | A | 9/1976 | Jorgensen | |
| 4,531,872 | A | 7/1985 | Warkotsh | |
| 4,582,307 | A | 4/1986 | Wang | |
| 4,794,810 | A | 1/1989 | Parsons | |
| 5,022,619 | A | 6/1991 | Mamada | |
| 6,250,621 | B1 | 6/2001 | Ping | |
| 6,299,152 | B1 | 10/2001 | Sangmeister et al. | |
| 6,343,783 | B1 * | 2/2002 | Ke | 269/139 |
| 2005/0218577 | A1 * | 10/2005 | Kent | 269/139 |

(Continued)

FOREIGN PATENT DOCUMENTS

| | | |
|---|---|---|
| DE | 198374 | 5/1908 |

(Continued)

*Primary Examiner*—Lee D. Wilson
(74) *Attorney, Agent, or Firm*—Harness, Dickey & Pierce P.L.C.

(57) ABSTRACT

A workbench has at least one drive member to clamp table members against one another. The drive member has a receiving tube and a crank tube. The receiving tube and crank tube are coupled with respect to one another for telescoping movement. One of the tubes has a threaded member and the other tube has a thread engaging member. A mechanism engages and disengages the thread engaging member into the threaded member such that in an engaged position, the crank tube can be rotated in the receiving tube for screw type movement. In a disengaged position, the crank tube is freely slidable for sliding movement in the receiving tube.

13 Claims, 5 Drawing Sheets

U.S. PATENT DOCUMENTS

2007/0018371 A1* 1/2007 Campbell et al. ..... 269/139

FOREIGN PATENT DOCUMENTS

| | | |
|---|---|---|
| DE | 341312 | 9/1921 |
| DE | 1244078 | 7/1967 |
| DE | 1918384 | 2/1970 |
| DE | 2326546 | 12/1974 |
| DE | 2414532 | 10/1975 |
| DE | 2928167 | 1/1981 |
| DE | 2942759 | 5/1981 |
| DE | 328648 | 2/1984 |
| DE | 8517217.0 | 8/1985 |
| DE | 3525196 | 1/1987 |
| DE | 8812523.8 | 2/1990 |
| EP | 1 003 629 | 5/2000 |
| EP | 0 774 599 | 12/2001 |
| GB | 2 272 175 | 5/1994 |

* cited by examiner

QUICK CLAMPING SYSTEM FOR A WORKBENCH

FIELD OF THE INVENTION

The present invention relates to workbenches or tables and, more particularly, to those which are portable and include an integral clamping table or vise. More particularly, the invention relates to a quick clamping system to clamp items on the table device.

BACKGROUND OF THE INVENTION

Carpenters, woodworkers and other handymen who work with wood as well as other materials, often need a workbench or table which can be utilized to hold or maintain workpieces. Ordinarily, these workbenches include a vise which clamps portions of the table top together to secure the workpiece on the table. One such device is that sold by the assignee of the present invention under the WORKMATE trademark. These tables are versatile, provide secure clamping, and are compact and convertible to dual height positions.

The workbench ordinarily includes two vise screws with handles on each one. The vise screws, via the handles, are operated by the user. Accordingly, the user must crank the handles in order to clamp a workpiece in-between the device or table members. Thus, if the table members are spaced from one another and a smaller workpiece is to be clamped, the user must rotate or crank the screw members until the smaller workpiece is contacted. This is cumbersome and in some cases inconvenient. Accordingly, it would be desirable to have a screw mechanism which provided a quick clamping sliding movement to cover a significant distance when a large gap exists between the two table members. Also, in the event an irregular workpiece is to be clamped, the table members can rapidly moved to abut the irregular workpiece and then be rotated to a final tightened position.

SUMMARY OF THE INVENTION

Accordingly, it is an object of the present invention to provide an improved vise for a workbench which enables rapid movement of the table members with respect to one another.

In accordance with one aspect of the invention, a workbench comprises a frame. A table surface is secured to the frame. The table surface includes at least two members. At least one of the members is movable with respect to the other member to enable clamping of a workpiece between the at least two members. A mechanism enables movement of the at least two members. The mechanism includes at least one drive member which includes a receiving tube and a crank tube. The receiving tube and crank tube are coupled with one another for telescoping movement. One of the tubes has a threaded member and the other tube has a thread engaging member. A mechanism engages and disengages the thread engaging member into the threaded member. In an engaging position, the crank tube can be rotated in the receiving tube, and vice versa, to provide screw type movement between the tubes. In a disengaged position, the crank tube and receiving tube are freely slidable with respect to one another. Ordinarily, the worktable includes two drive mechanisms. The drive mechanisms include a crank coupled with the crank tube. A push rod extends through the crank tube and has one of its ends coupled with the thread engaging member. In one embodiment, the thread engaging member includes a block having a tapered surface with rollers riding on the tapered surface. The rollers project through apertures in the crank tube so that in an engaged position, the rollers engage the threaded member to enable screw type movement. In a second embodiment, the thread engaging member includes a pivotal plate with an aperture, a slot and one or more teeth, which engage the threaded member. The plate is pivoted between an engaging and disengaging position which enables screw type and sliding movement, respectively. Generally the receiving tube is stationarily positioned on the frame. Also, a biasing member is positioned in the crank tube to bias the push rod in a first position where the thread engaging member is in the engaged position.

According to a second aspect of the invention, a clamping drive comprises a drive member with a receiving tube and a crank tube. The receiving tube and crank tube are coupled with respect to one another for telescoping movement. One of the tubes has a threaded member and the other a thread engaging member. A mechanism engages and disengages the thread engaging member into the threaded member. In an engaged position, the crank tube can be rotated with respect to the receiving tube in a screw type manner. In a disengaged position, the crank tube is freely slidable with respect to the receiving tube. The mechanism includes a crank coupled with the crank tube and a push rod extending through the crank tube. One end of the push rod is coupled with the thread engaging member. In one embodiment, the thread engaging member includes a block member with a tapered surface and rollers riding on the tapered surface. The rollers project through apertures in the crank tube. In an engaged position, the rollers engage the threaded member to enable screw type movement. In a second embodiment, the engaging member includes a pivotal plate with an aperture, a slot and one or more teeth, which engage the threaded member. The plate is pivoted between a first and second position to enable screw type or sliding movement between the two tubes. A biasing member is positioned in the crank tube to bias the push rod into a first position where the thread engaging member is engaged.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The accompanying drawings which are incorporated in and constitute a part of the specification, illustrate embodiments of the present invention and together with the description, serve to explain the principles of the invention. In the drawings, the same reference numerals indicate the same parts.

DETAILED DESCRIPTION OF THE PREFERRED EMBODIMENTS

Figure 1:
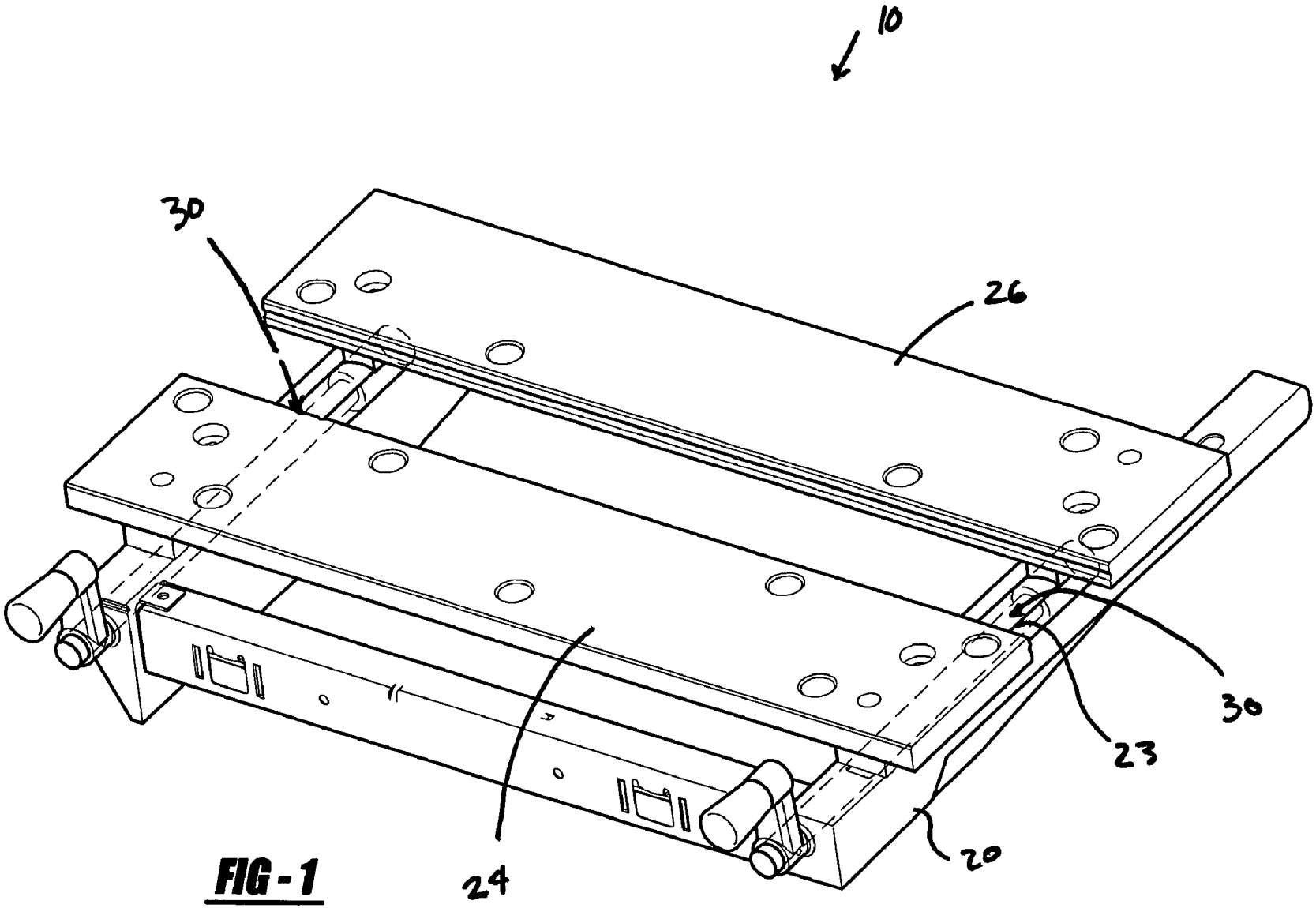
FIG. 1 is a perspective view of a workbench top in accordance with the present invention.
Figure 2:
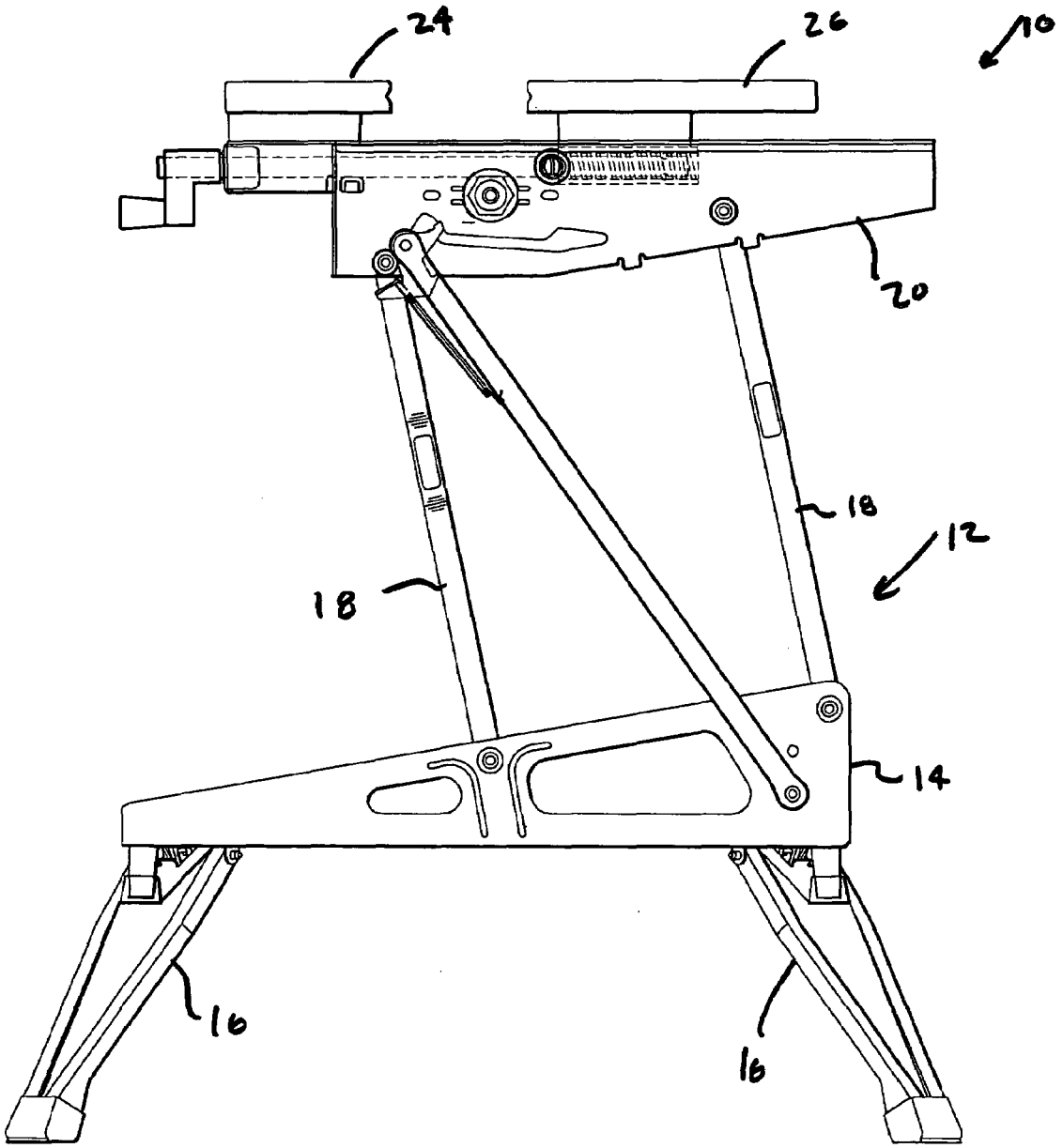
FIG. 2 is a side elevation view of the workbench with the top of FIG. 1.
Figure 3:
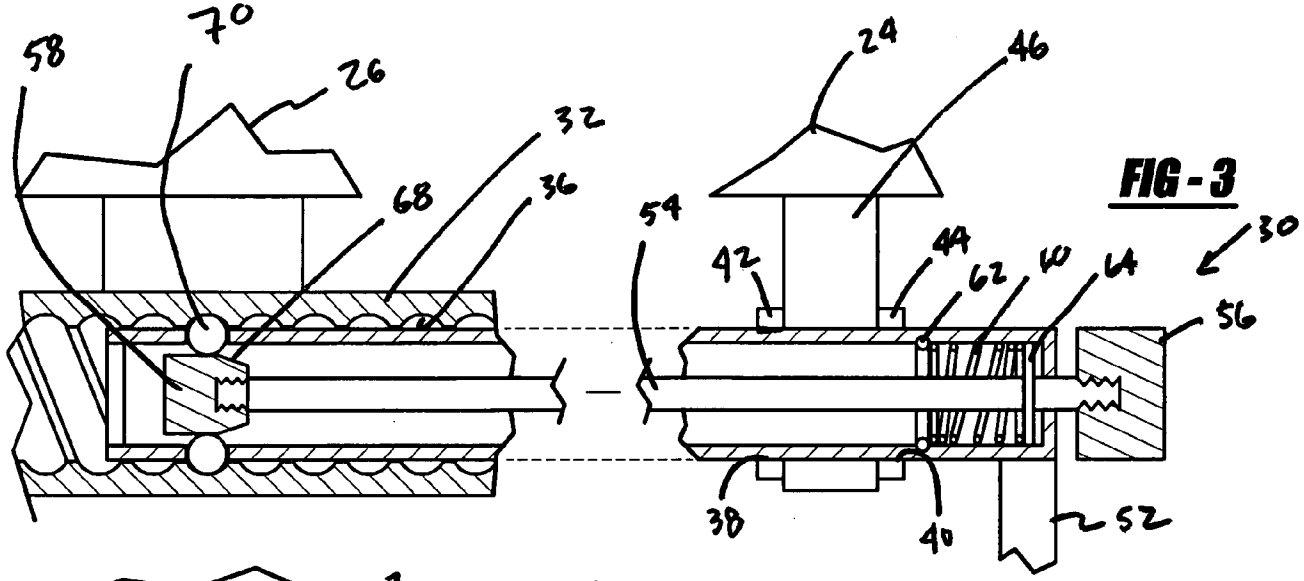
FIG. 3 is a cross section view through a drive mechanism of the table of FIG. 2 through line 3—3 thereof.
Figure 4:
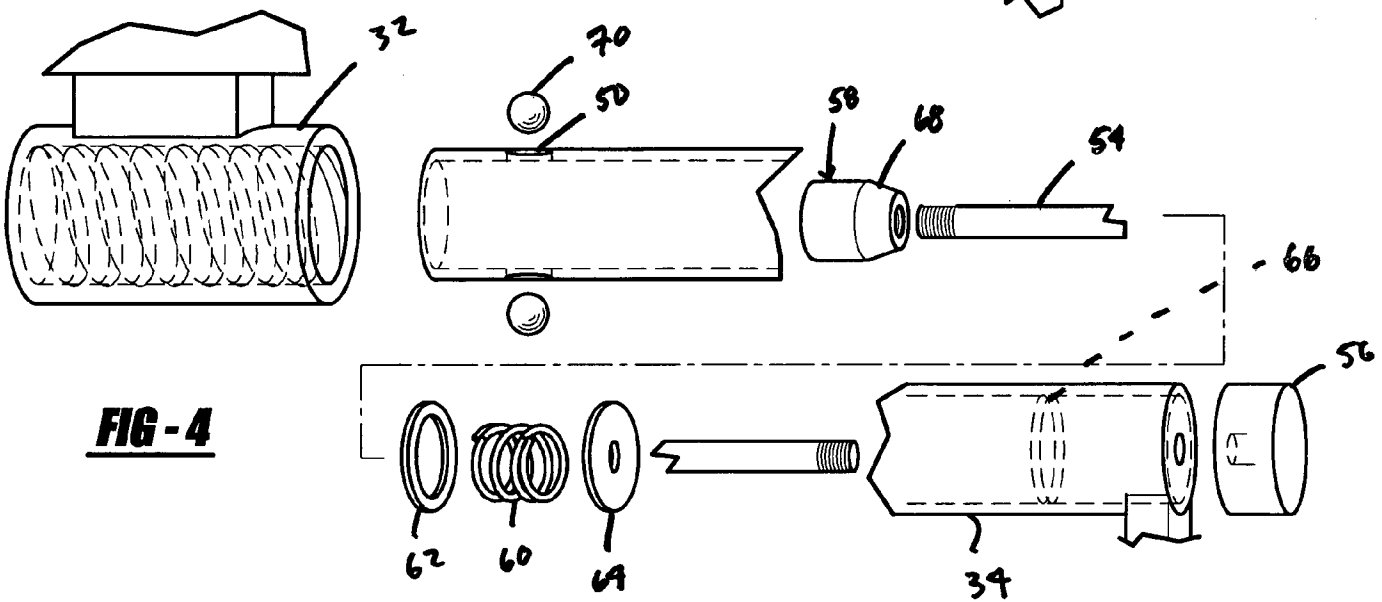
FIG. 4 is an exploded perspective view of the drive mechanism of FIG. 3.

Turning to the figures, a workbench is illustrated and designated with the reference numeral 10. The workbench includes a frame 12 which includes a base 14, four foldable legs 16, two upright H supports 18, which extend from the base, and brackets 20 at the other end of the supports 18. The workbench is generally formed from two table members 24 and 26 which are coupled with the two brackets 20. The brackets 20 are hollow and include elongated slots which enable movement of the table member 24 with respect to the brackets 20. Also, the brackets include apertures 23 to enable the second table member 26 to be stationarily locked into the brackets 20.

Two drive mechanisms 30 are positioned within the brackets 20. The drive mechanism 30 includes a receiving tube 32 and a crank tube 34. The receiving tube 32 is stationarily secured to the table member 26. The receiving tube 32 includes a thread 36 on its inside surface. The thread 36 is helical in fashion to enable screw type movement, as will be explained herein.

The crank tube 34 includes recesses 38 and 40 which receive C-clips 42 and 44 which retain the support 46 of the table member 24 on the crank tube 34. The crank tube 34 includes apertures 50 about its circumference near one end of the crank tube. Also, a lever or crank 52 is secured to the crank tube 34 at the other end of the tube.

A push rod 54 is positioned inside the crank tube 34. The push rod 54 generally has a threaded end with a button 56 on one end and a block 58 on the other. The button 56 is positioned externally of the crank tube 34 while the block 58 is positioned inside of the crank tube 34.

A biasing member 60 is positioned about the circumference of the push rod 54. The biasing member 60 is locked between bushing members 62 and 64. Bushing member 62 is secured within a recess 66 on the internal surface of the crank tube 34. The bushing 64 is secured to the push rod 54. Accordingly, the biasing member, in a first position, pushes against both bushings 62 and 64 to push the button away from the crank tube 34 in the first position.

The block 58 includes one or more tapered surfaces 68. In the event the block 58 is a cone, the tapered surface 68 would be continuous about the block 58. In the event the block 58 is polygonal, there would be a plurality of tapered surfaces 68. These surfaces would be separated by adjoining sides.

Rollers 70, which may be balls, pins, or the like, are positioned on the tapered surface 68. Also, the rollers 70 are captured in the apertures 50 of the crank tube 34. The apertures 50 act like a cage to retain the rollers 70 in the apertures on the crank tube. The rollers 70 act as a thread engaging member to engage the thread 36. Thus, when the crank tube 34 is rotated, the crank tube moves with respect to the receiving tube 32 in a screw type pattern. Accordingly, when the rollers 70 engage the thread 36, the tubes act as a screw joint.

When the push button 56 is pushed inward against the bias of the spring 60, the block 58 moves away from the rollers 70. As this occurs, the rollers 70 move inward along the tapered surfaces 68. Thus, the rollers 70 disengage from the thread 36 of the receiving tube 32. Accordingly, the crank tube 34 can be freely slid inside of the receiving tube 32. This enables a quick or fast sliding movement to close a gap between the two table members 24 and 26. Thus, the drive mechanisms 30 enable sliding, as well as screw type, movement. Accordingly, this enables rapid tightening or clamping of the table members 24 and 26 by a sliding movement and a precise slower tightening or clamping of the table members 24 and 26 by the screwing movement. Further, the tightening or clamping can be accomplished by the user with a single hand.

Figure 5:
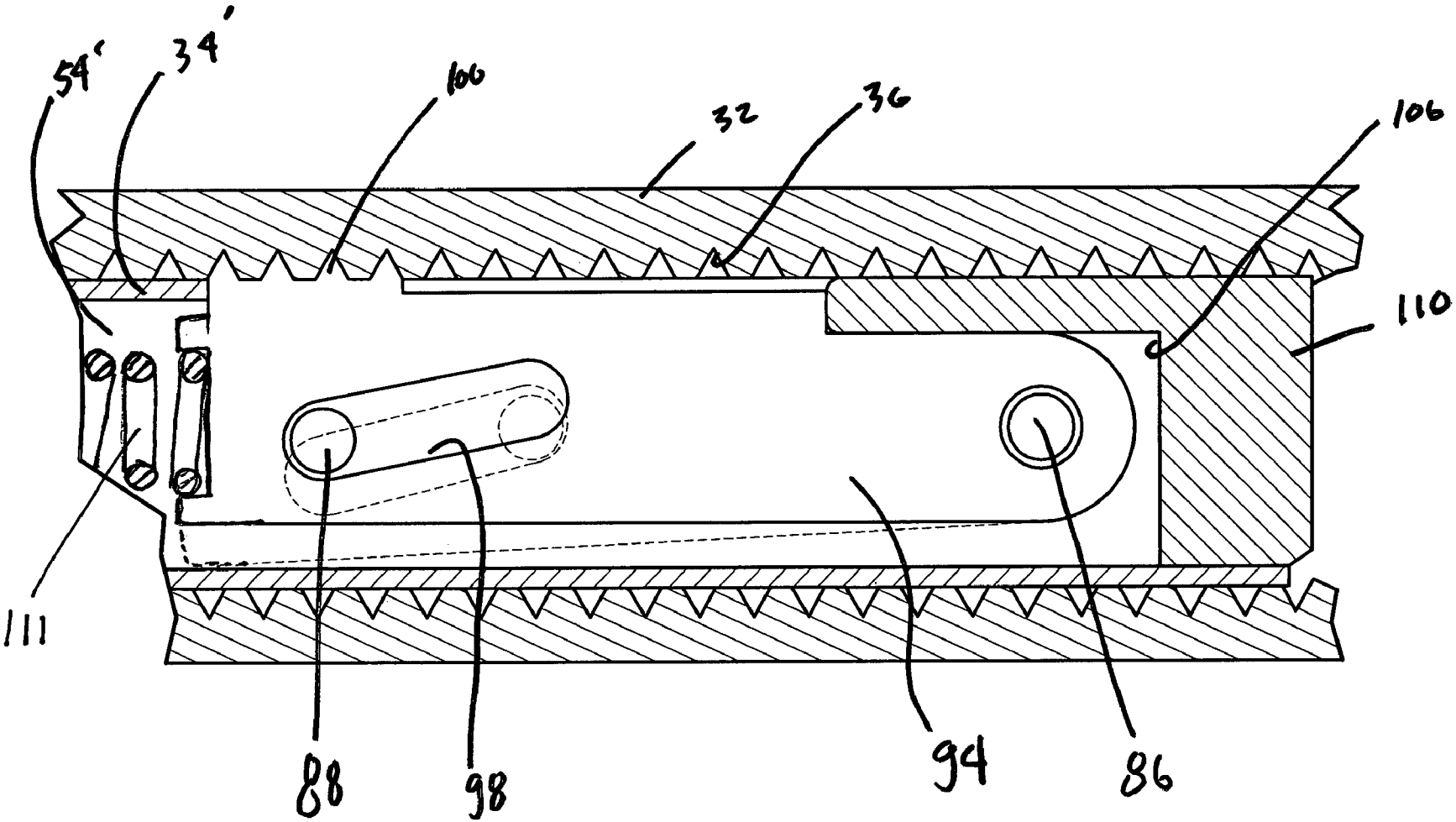
FIG. 5 is a cross section view of a drive mechanism of a second embodiment of the present invention.
Figure 6:
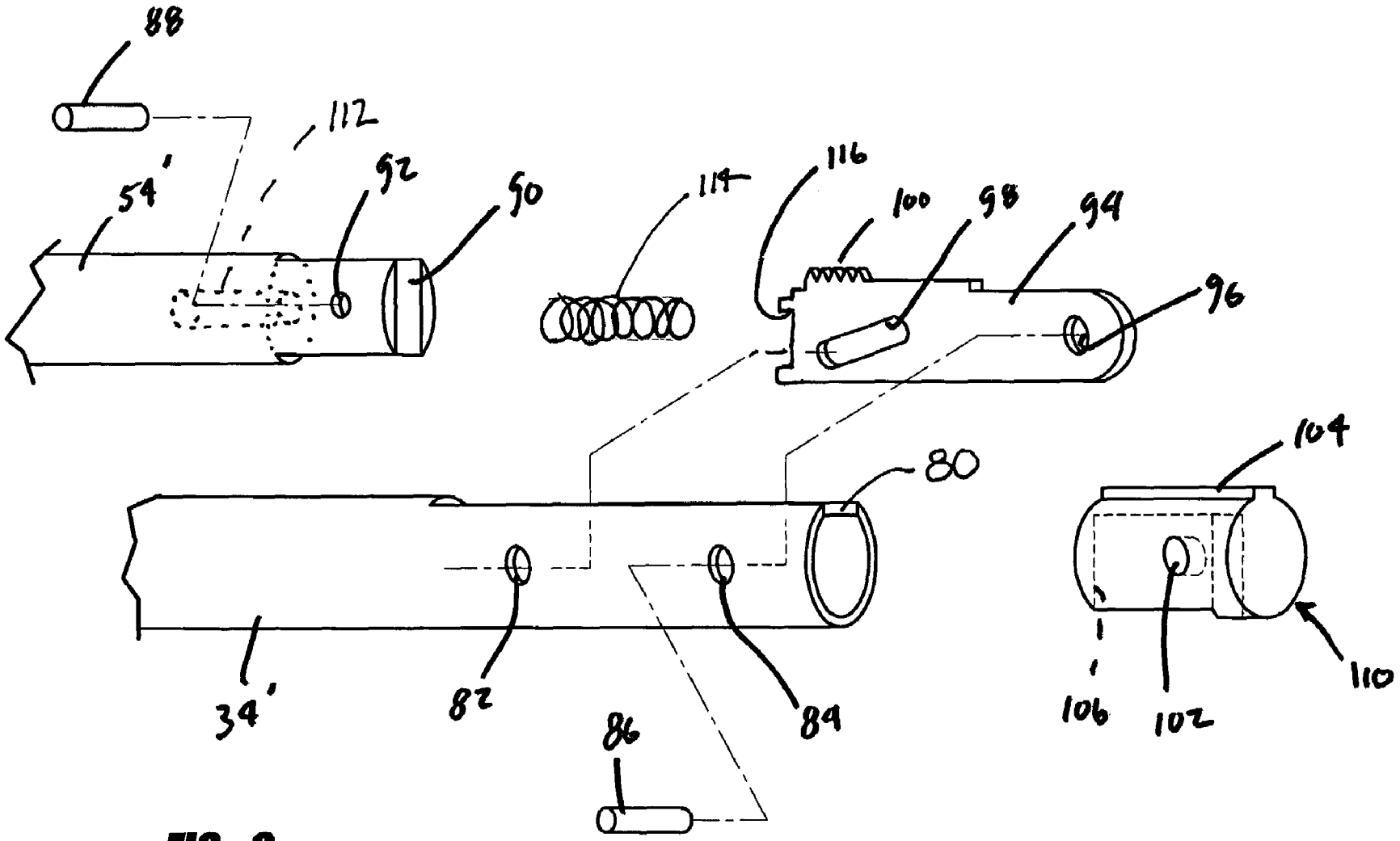
FIG. 6 is an exploded perspective view of the drive mechanism of FIG. 5.

Turning to FIGS. 5 and 6, an additional embodiment is shown. Here, the elements which are the same are identified with the same reference numerals.

The difference between the second embodiment and the first embodiment is in the crank tube 34'. The crank tube 34' includes a slot 80 and through apertures 82 and 84. The apertures 82 and 84 receive a pivot pin 86, and a shorter actuator pin 88, respectively.

The push rod 54' includes a slot 90 and an aperture 92. The aperture 92 enables passage of the actuator pin 88. The slot 90 receives a plate 94. The slot 90 includes a spring cavity 112.

The plate 94 includes an aperture 96, slot 98 and teeth 100 and a spring retaining member 116, which maintains an end of spring 114 on the plate 94. The aperture 96 receives the pivot pin 86, while the slot 98 receives the actuator pin 88. The teeth 100, on one edge of the plate 94, are the thread engaging member of the present embodiment. The teeth 100 engage the thread 36 of the receiving member 32. Also, a pivot plug 110 may be included at the end of the crank tube 34'. The pivot plug 110 includes an aperture 102 to receive the pivot pin 86 and a key 104 which slides into the slot 80. Also, a cavity 106 is formed inside of the pivot pin to receive a portion of a plate 94. A spring or biasing member 114 is received in spring cavity 112.

The user, using a single hand, moves the push button 56 inwardly which, in turn, drives the push rod 54' against the biasing spring 114, to move the actuator pin 88 in slot 98 along the plate 94. As this occurs, due to the taper or angle of the slot 98, the plate 94 is pivoted downward at the pivot pin 86. As this happens, the teeth 100 disengage from the thread 36. When the single hand removes the force from the button 54, the spring 114 moves from a compressed position to an extended position which, in turn, moves the push rod 54', attached to the actuator pin 88, away from the pivot plug 110 along the slot 98. As this occurs, the plate 94 pivots upwardly to re-engage the teeth 100 into the thread 36. Thus, in the disengaged position, the drive mechanism 30 enables free sliding movement while in the engaged position, the invention enables screw type movement, as explained above While the above detailed description describes the preferred embodiment of the present invention, the invention is susceptible to modification, variation, and alteration without deviating from the scope and fair meaning of the subjoined claims.

What is claimed is:

1. A workbench comprising:

a frame;

a table surface on said frame, said table surface including at least two members, at least one of said members movable with respect to the other member for enabling clamping of a workpiece between said at least two members;

a mechanism for enabling movement of said at least one member;

said mechanism comprising at least one drive member having a receiving tube and a crank tube, said receiving tube and crank tube coupled with one another for telescoping movement, one of said tubes having a threaded member and the other of said tubes having a thread engaging member;

a mechanism for engaging and disengaging said thread engaging member in said threaded member such that when in an engaged position, said crank tube can be rotated in said receiving tube for screw type movement in said receiving tube and when in a disengaged position, said crank tube being freely slidable in said receiving tube.

2. The workbench according to claim 1 including two drive mechanisms.

3. The workbench according to claim 1, wherein said mechanism including a crank coupled with said crank tube, a push rod extending through said crank tube, one end of said push rod coupled with said thread engaging member.

4. The workbench according to claim 3, wherein said thread engaging member comprising a block member having a tapered surface with rollers riding on said tapered surface, said rollers projecting through apertures in said crank tube, in said engaged position, said rollers engage said threaded member enabling screw type movement.

5. The workbench according to claim 3, said thread engaging member comprising a pivotal plate having an aperture, a slot and one or more teeth for engaging said threaded member.

6. The workbench according to claim 3, wherein a biasing member is positioned in said crank tube for biasing said push rod in a first position wherein said thread engaging member is engaged.

7. The workbench according to claim 1, wherein said receiving tube is stationarily positioned on said frame.

8. A telescoping or indexing drive comprising:

at least one drive member having a receiving tube and a crank tube, said receiving tube and crank tube coupled with one another for telescoping movement, one of said tubes having a threaded member and the other of said tubes having a thread engaging member;

a mechanism for engaging and disengaging said thread engaging member in said threaded member such that when in an engaged position said crank tube is rotated in said receiving tube for screw type movement in said receiving tube and when in a disengaged position, said crank tube being freely slidable in said receiving tube.

9. The telescoping or indexing device according to claim 8, wherein said mechanism including a crank coupled with said crank tube, a push rod extending through said crank tube, one end of said push rod coupled with said thread engaging member.

10. The telescoping or indexing device according to claim 9, wherein said thread engaging member comprising a block member having a tapered surface with rollers riding on said tapered surface, said rollers projecting through apertures in said crank tube, and in said engaged position, said rollers engage said threaded member enabling screw type movement.

11. The telescoping or indexing device according to claim 9, said thread engaging member comprising a pivotal plate having an aperture, a slot and one or more teeth for engaging said threaded member.

12. The telescoping or indexing device according to claim 9, wherein a biasing member is positioned in said crank tube for biasing said push rod in a resting position wherein said thread engaging member is engaged.

13. The telescoping or indexing device according to claim 8, said drive is operated by a single hand of a user.

* * * * *